US006522116B1

(12) United States Patent
Jordan

(10) Patent No.: US 6,522,116 B1
(45) Date of Patent: Feb. 18, 2003

(54) SLOPE COMPENSATION CIRCUIT UTILIZING CMOS LINEAR EFFECTS

(75) Inventor: Mark G. Jordan, Goffstown, NH (US)

(73) Assignee: Linear Technology Corporation, Milpitas, CA (US)

( * ) Notice: Subject to any disclaimer, the term of this patent is extended or adjusted under 35 U.S.C. 154(b) by 110 days.

(21) Appl. No.: 09/617,179

(22) Filed: Jul. 17, 2000

(51) Int. Cl.[7] ..... G05F 1/40; G05F 5/00
(52) U.S. Cl. ..... 323/288; 323/299
(58) Field of Search ..... 323/222, 282, 323/284, 285, 288, 290, 299

(56) References Cited

U.S. PATENT DOCUMENTS

| | | | | | |
|---|---|---|---|---|---|
| 4,837,495 | A | * | 6/1989 | Zansky | 323/222 |
| 4,975,820 | A | | 12/1990 | Szepesi | 363/21 |
| 5,305,192 | A | | 4/1994 | Bonte et al. | 363/21 |
| 5,585,741 | A | | 12/1996 | Jordan | 326/30 |
| 5,717,322 | A | | 2/1998 | Hawkes et al. | 323/283 |
| 6,049,473 | A | * | 4/2000 | Jang et al. | 363/89 |
| 6,100,677 | A | * | 8/2000 | Farrenkopf | 323/285 |
| 6,222,356 | B1 | | 4/2001 | Taghizadeh-Kaschani | 323/288 |

OTHER PUBLICATIONS

"Subharmonic Oscillations" *1990 Linear Applications Handbook, A Guide To Linear Circuit Design, Note AN19—LT1070 Design Manual*, vol. I pp. AN19–1–AN19–76. (No month).

"Modelling, Analysis and Compesation of the Current–Mode Converter", *Texas Instruments Application Note U–97*, pp. 3–43.3–49. (No date).

* cited by examiner

*Primary Examiner*—Jessica Han
(74) *Attorney, Agent, or Firm*—Fish and Neave; Michael E. Shanahan; Jeffrey C. Aldridge

(57) ABSTRACT

A slope compensation circuit that provides slope compensation signals for switching voltage regulators is provided. The slope compensation circuit includes a feedback circuit, a control circuit, and a slope signal generator circuit. The feedback circuit generates a feedback signal that is indicative of both input and output voltages. The control circuit acts as a voltage controlled resistor that varies its resistance based on the feedback signal in order to control the slope signal generator circuit so that an optimum amount of slope compensation is provided.

29 Claims, 4 Drawing Sheets

SLOPE COMPENSATION CIRCUIT UTILIZING CMOS LINEAR EFFECTS

BACKGROUND OF THE INVENTION

The present invention relates to switching regulator circuits. More particularly, the present invention relates to circuits and methods for providing slope compensation signals for voltage regulators based on input and output voltages.

The purpose of a voltage regulator is to provide a predetermined and substantially constant output voltage to a load from a voltage source which may be poorly-specified or fluctuating. Two types of regulators are commonly used to provide this function, a linear regulator and a switching regulator. In a typical linear regulator, the output voltage is regulated by controlling the flow of current through a pass element from the voltage source to the load.

In switching voltage regulators, however, the flow of current from the voltage source to the load is not steady, but rather in the form of discrete current pulses. To create the discrete current pulses, switching regulators usually employ a switch (such as a power transistor) that is coupled either in series or parallel with the load. The current pulses are then converted into a steady load current with an inductive storage element.

By controlling the duty cycle of this switch (i.e., the percentage of time that the switch is ON relative to the total period of the switching cycle), the switching voltage regulator can regulate the load voltage. In current-mode switching voltage regulators (i.e., a switching regulator that is controlled by a current-derived signal in the regulator) there is an. inherent instability when the duty cycle exceeds 50% (i.e., when the switch is ON for more than 50% of a given switching period). Stability is often maintained in such current-mode switching regulators by adjusting the current-derived signal used to control the regulator with a slope compensation signal.

One method of producing such slope compensation signals is to use a portion of a ramp signal as the compensation signal. The ramp signal may be, for example, an oscillator signal that is used to generate a clock signal that controls the switching of the regulator. The slope compensation signal can be applied by either adding the ramp signal to the current-derived signal, or by subtracting it from a control signal.

An example of a typical prior art circuit 10 that provides slope compensation for a switching voltage regulator is shown in FIG. 1. The circuit of FIG. 1 operates as follows. Oscillator circuit 30 provides a ramp signal such as a sawtooth waveform to the base of transistor 20. As the sawtooth waveform ramps up, transistor 20 begins to conduct, and current flows from voltage source 28 to resistor 22 creating a voltage at node 23, which is applied to the non-inverting input 34 of amplifier 32. Generally speaking, as the sawtooth waveform increases in magnitude, so does the voltage at node 23 and vice versa. This signal is generally known as the slope compensation signal. Usually, the sawtooth waveform produced by oscillator 30 is substantially in-phase with a clock signal that is used to coordinate the switching of a power transistor (not shown) within the voltage regulator. This is done to ensure that slope compensation is provided at the proper time relative to the duty cycle of the power transistor (e.g., when the duty cycle exceeds a predetermined value). The maximum amount of slope compensation is provided when the sawtooth waveform reaches its peak, and conversely, the minimum amount of slope compensation is provided (if any) when the sawtooth waveform is at its minimum.

The current provided by the voltage regulator is monitored by sensing the output current present in a storage inductor (not shown) located in the output stage of the voltage regulator. This current is measured in FIG. 1 by passing a signal indicative of the output current through sensing resistor 26. This creates a voltage at node 25 that indicates the amount of current the voltage regulator is providing. This voltage is sensed at error amplifier 32 by measuring the voltage drop between non-inverting terminal 34 and inverting terminal 36 (i.e., across a current sense resistor 26). The voltage regulator compares the output of current sense amplifier 32 to a preset threshold value to determine when to open and close a power switch that provides current to the load.

Slope compensation is provided in FIG. 1 by adding the voltage present at node 25 with the slope compensation voltage provided at node 23. With no slope compensation provided, the voltage at non-inverting terminal 34 is approximately equal to the voltage at node 25. When slope compensation is provided, however, and the sawtooth waveform progresses toward its peak, the voltage at node 23 rises, which consequently increases the voltage at non-inverting terminal 34. The voltage regulator interprets this as an increase in the rate of current rise in the output inductor. This causes the perceived rate of current rise in the inductor to be greater than the rate of current fall, which allows the voltage regulator to operate at duty cycles greater than 50% without becoming unstable.

One shortcoming of this technique is that it fails to produce slope compensation with respect to the input voltage provided to the regulator. This is a significant deficiency because the value of the input voltage directly effects the duty cycle of the regulator. For example, as input voltage decreases, the duty cycle must increase to maintain output voltage. Thus, slope compensation must increase accordingly to ensure regulator stability.

In the past, circuit designers have accounted for this problem by providing slope compensation based on "worst-case" input voltage conditions. This, however, often results in the production of excessive amounts of slope compensation, which is generally undesirable, because it can significantly reduce the response time of the regulator.

It would therefore be desirable to provide a slope compensation circuit that provides slope compensation to a switching voltage regulator as a function of input voltage.

It would also be desirable to provide a slope compensation circuit that provides optimum amounts slope compensation based on the amount needed to ensure regulator stability.

SUMMARY OF THE INVENTION

It is therefore an object of the present invention to provide a slope compensation circuit that provides slope compensation to a switching voltage regulator as a function of input voltage.

It is another object of the present invention to provide a slope compensation circuit that provides optimum amounts slope compensation based on the amount needed to ensure regulator stability.

These and other objects of the present invention are accomplished by providing a slope compensation circuit that provides slope compensation as a function of both input voltage and output voltage. This allows the slope compensation circuit to provide the optimum amount of slope compensation so that the response time of the voltage regulator is improved and the current limit effects of slope compensation are minimized.

The slope compensation circuit includes a control circuit, a feedback circuit, and a slope signal generator circuit. The feedback circuit produces a feedback signal which is a function of both input voltage and output voltage. The control circuit generates a control signal based on the feedback signal that varies the impedance of circuit elements within it to establish the slope of current that can be conducted by the slope signal generator circuit. This allows the slope signal generator circuit to produce slope compensation signals that are specifically tailored to the stability requirements of the regulator in view of the input and output voltages.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which.

DETAILED DESCRIPTION OF THE INVENTION

Figure 1:
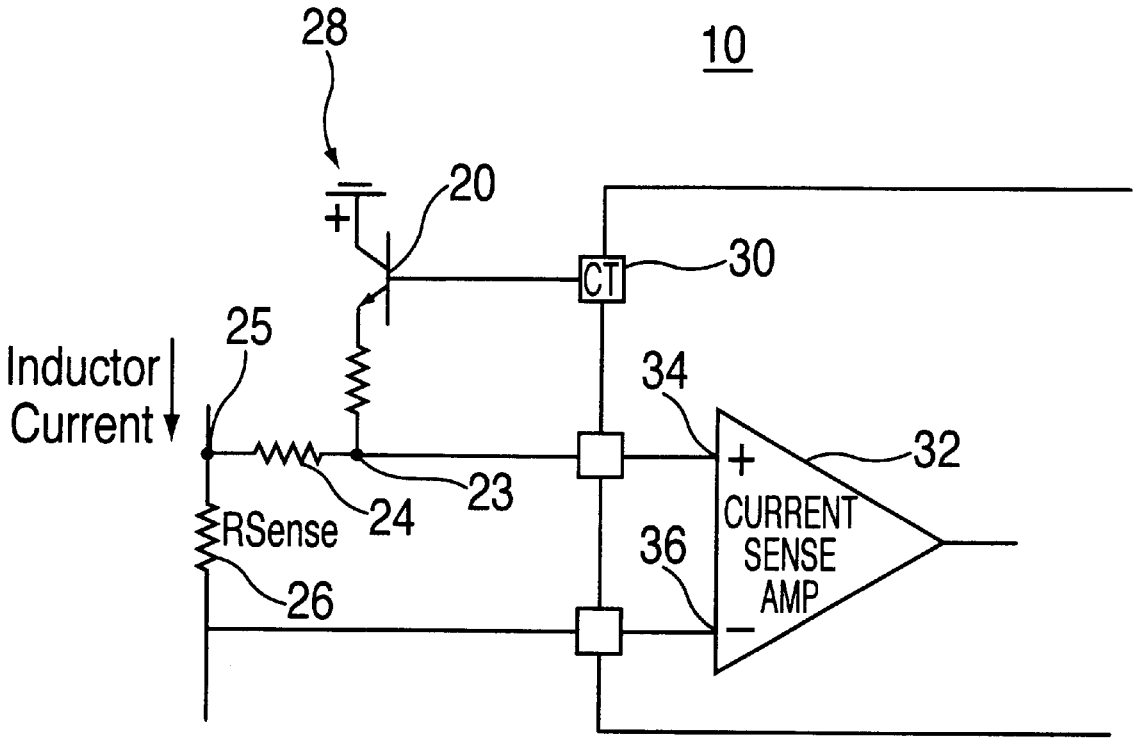
FIG. 1 (PRIOR ART)
FIG. 1 is a schematic diagram of a prior art slope compensation circuit.
Figure 2:
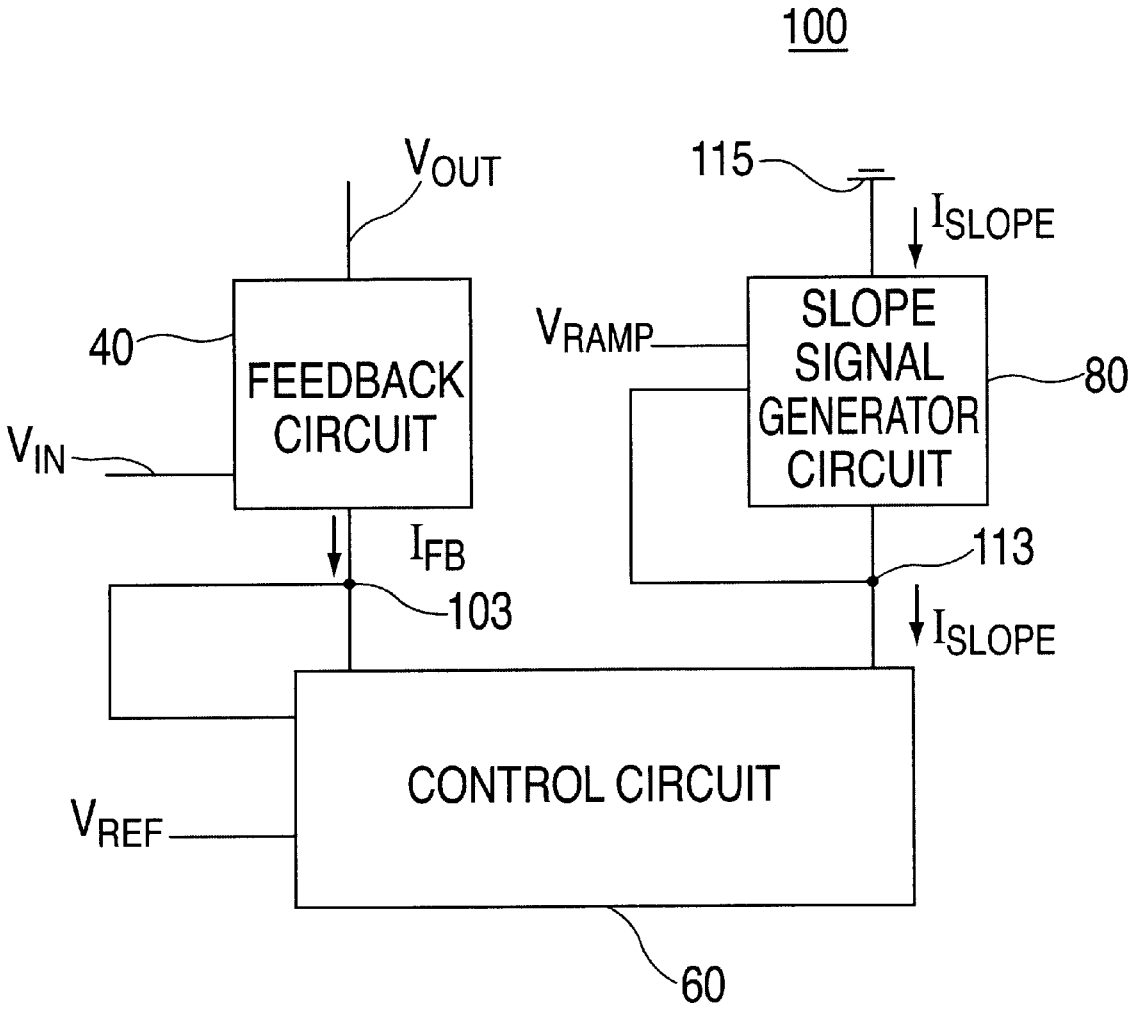
FIG. 2 is a block diagram of a slope compensation circuit constructed in accordance with principles of the present invention.

A slope compensation circuit 100, constructed in accordance with the principles of the present invention and suitable for use with a switching voltage regulator circuit is illustrated in FIG. 2. The slope compensation circuit of FIG. 2 generally includes feedback circuit 40, control circuit 60 and slope signal generator circuit 80.

In the arrangement of FIG. 2, a feedback signal ($I_{FB}$), indicative of an input voltage ($V_{IN}$) provided to a voltage regulator 200 (shown in FIG. 4) and an output voltage ($V_{OUT}$) provided by regulator 200, is generated by feedback circuit 40. Feedback circuit 40 provides feedback signal $I_{FB}$, which is a function of both the input and output voltage, to control circuit 60 at node 103. As shown in FIG. 2, control circuit 60 is connected to a preset reference voltage ($V_{REF}$) and to slope signal generator circuit 80.

In operation, control circuit 60 acts as a voltage controlled resistor and controls the amount of current that can pass through feedback circuit 40 and slope signal generator circuit 80. Generally speaking, the more slope compensation regulator 200 requires, the lower the equivalent resistance of control circuit 60 and vice versa. In preferred embodiments, the amount of current that flows through feedback circuit 40 ($I_{FB}$) is proportional to the amount of current that flows through slope signal generator circuit 80 ($I_{SLOPE}$). This allows the magnitude of a slope compensation signal ($I_{SLOPE}$) generated by circuit 100 to be adjusted with respect to the amount of input voltage provided to voltage regulator 200 and the output voltage provided by regulator 200.

The general concept behind circuit 100 is to provide the proper or "optimum" amount of slope compensation depending on conditions at the input and the output of regulator 200 in order to maintain regulator stability. This is a considerable improvement over prior art circuits that provide fixed amounts of slope compensation based on "worst-case" fluctuations of input voltage.

FIG. 2 shows one possible implementation of slope compensation circuit 100 suitable for use with a boost voltage regulator topology. Although the principles of the present invention will be described herein with reference to the boost regulator topology shown in FIG. 4, it will be understood that this is merely illustrative and the that present invention may be practiced with other regulator topologies (e.g., buck, buck-boost, etc.).

In the circuit of FIG. 2, when the output voltage ($V_{OUT}$) of regulator 200 begins to rise above a desired level, the duty cycle of a power switch 204 (FIG. 4) that controls the current supplied by the regulator begins to increase. This means that the amount of slope compensation required to maintain regulator stability also increases. In this instance, it would be desirable to increase the amount of slope compensation provided, but only to the extent that enough is added to ensure regulator stability.

Figure 4:
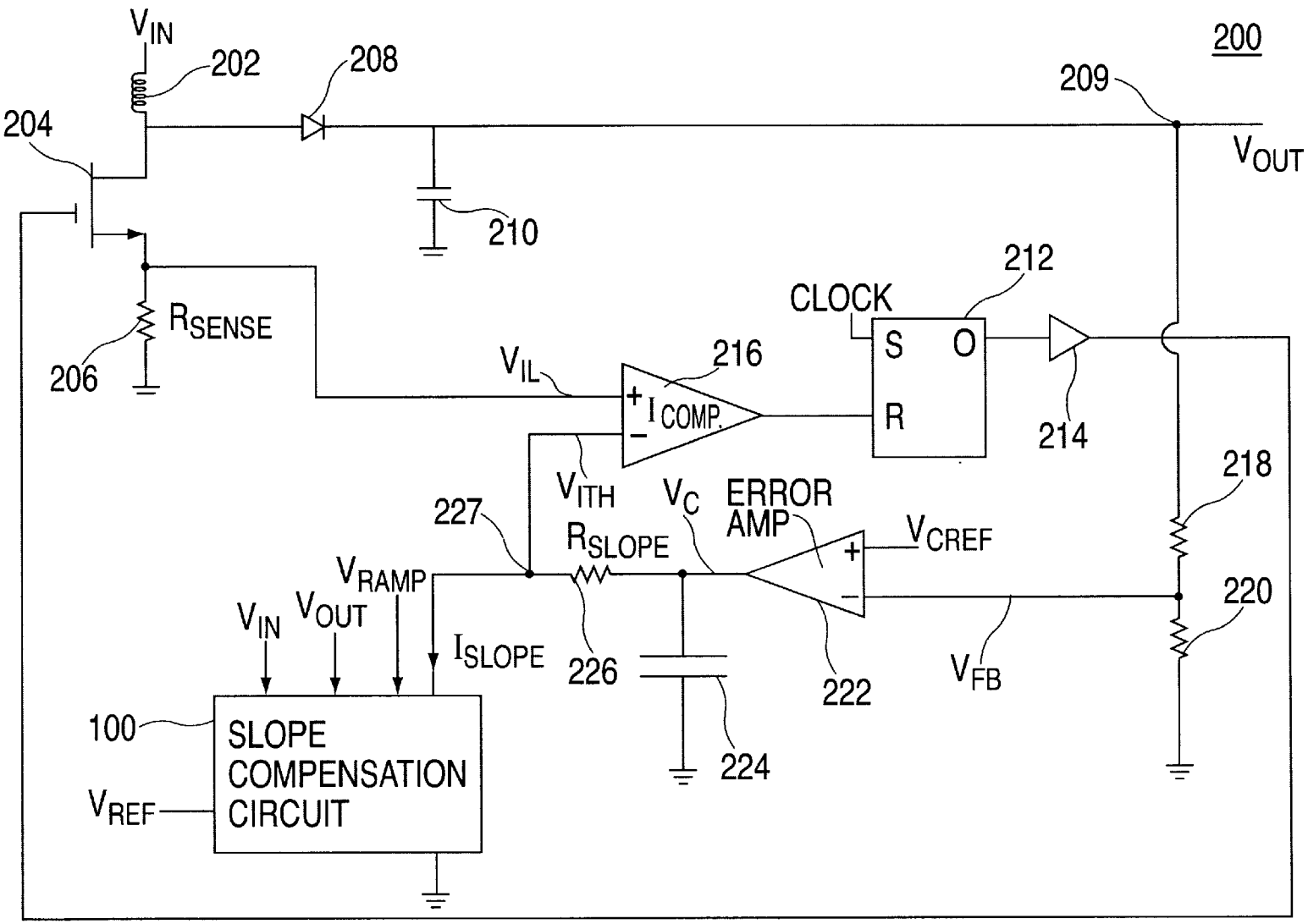
FIG. 4 is a schematic diagram of a voltage regulator circuit that may employ the slope compensation circuit of FIGS. 2 and 3.

In operation, circuit 100 senses the changing slope compensation requirements of regulator 200 with feedback circuit 40. As the output voltage ($V_{OUT}$) begins to rise above a desired level, the magnitude of the $I_{FB}$ signal, generated by feedback circuit 40, begins to increase correspondingly. This, in turn, causes the equivalent resistance of control circuit 60 to decrease so that the current flowing through slope signal generator circuit 80 ($I_{SLOPE}$) also increases. The net effect is that the amount of slope compensation provided increases (based on the increase in output voltage), but only an appropriate amount so that regulator 200 remains stable. In FIG. 4, as the magnitude of $I_{SLOPE}$ increases, the amount of slope compensation provided to regulator 200 also increases (and vice versa).

Another possible operating scenario is where the input voltage ($V_{IN}$) supplied to the regulator begins to decrease. In this case, the duty cycle of power switch 204 (FIG. 4) needs to increase to maintain a regulated output voltage. This means a greater amount of slope compensation is required to maintain regulator stability. Thus, it would be desirable to increase slope compensation, but only to the extent that the necessary extra amount is added to ensure regulator stability.

Feedback circuit 40 senses the changing slope compensation requirements of regulator 200. As the input voltage ($V_{IN}$) begins to drop, the magnitude of the $I_{FB}$ signal, generated by feedback circuit 40, begins to increase correspondingly. This, in turn, causes the equivalent resistance of control circuit 60 to decrease so that the current ($I_{SLOPE}$) flowing through slope signal generator circuit 80 is allowed to increase. The net effect is that the amount of slope compensation provided increases, but only by the amount required to maintain regulator stability plus a safety margin. This can be seen in FIG. 4, where as the magnitude of $I_{SLOPE}$ increases, the amount of slope compensation provided to regulator 200 also increases.

Other operating scenarios other than the ones specifically described above are also accounted for by the arrangement shown in FIG. 2. For example, if the input voltage ($V_{IN}$) increases, the duty cycle necessary to maintain a regulated output voltage will decrease. In this case, circuit 100 will decrease slope compensation accordingly. If the output voltage ($V_{OUT}$) decreases, the duty cycle necessary to maintain a regulated voltage will decrease. In this case, circuit 100 will decrease slope compensation accordingly. In this case, circuit 100 will decrease slope compensation accordingly. In other situations, where both the input and output voltages ($V_{IN}$, $V_{OUT}$) vary or fluctuate, circuit 100 will adjust the slope compensation such that the proper amount of slope compensation is provided for the duty cycle necessary to maintain a regulated output voltage.

Thus, as can be seen from the above, circuit 100 allows the amount of slope compensation provided to a voltage regulator to be tailored to specific needs of the regulator depending on both input and output voltages.

Figure 3:
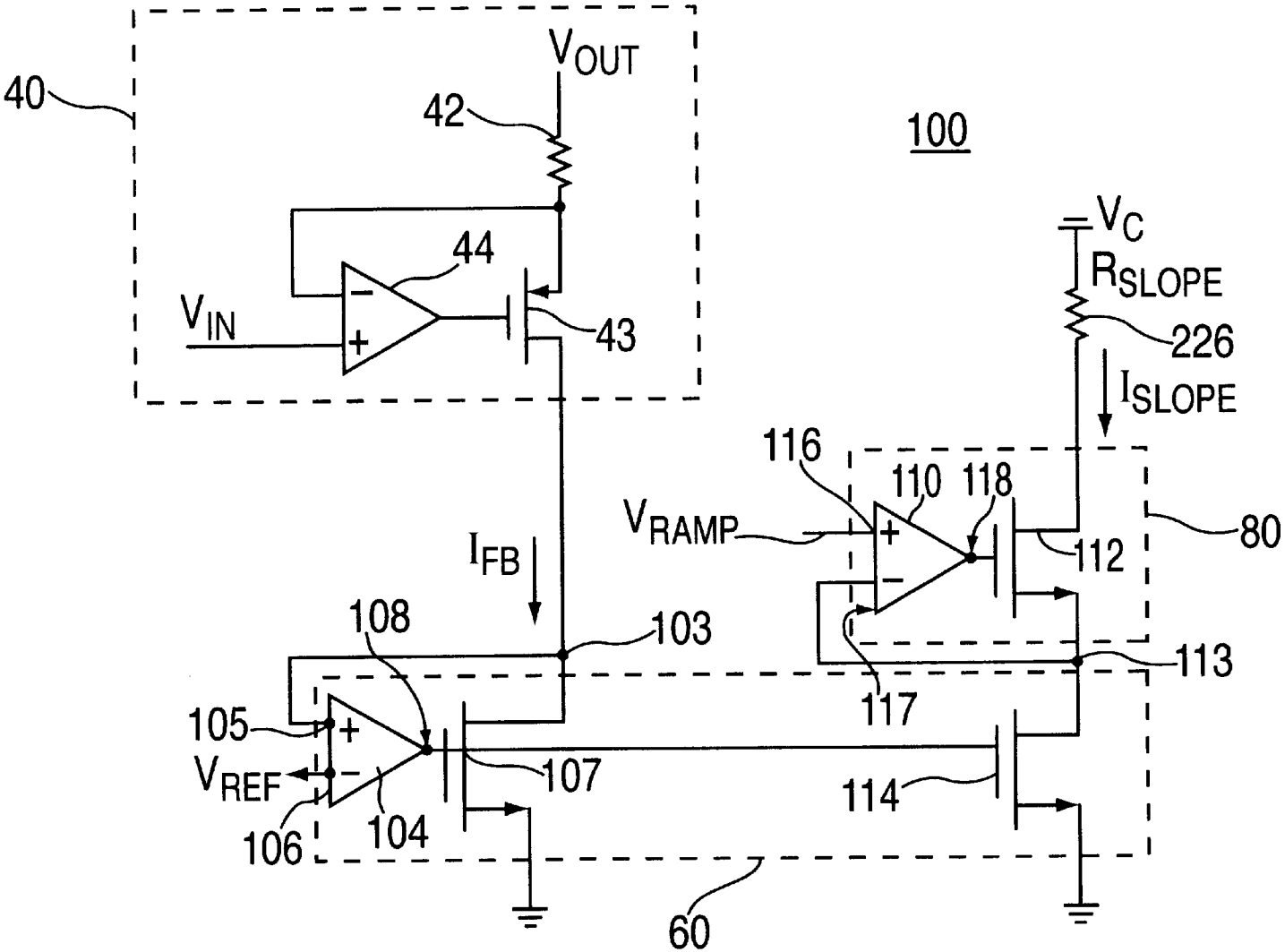
FIG. 3 is a schematic diagram of a slope compensation circuit constructed in accordance with principles of the present invention.

A schematic diagram of a preferred embodiment of slope compensation circuit 100 illustrated in FIG. 2 is shown in FIG. 3. As shown in FIG. 3, feedback circuit 40 may include a resistor 42, a field-effect- transistor (FET) 43, and an operational amplifier (op-amp) 44. Assuming a sufficient input voltage ($V_{IN}$) is applied to regulator 200 and it is producing an output voltage ($V_{OUT}$), FET 43 is ON, and feedback signal $I_{FB}$ flows from $V_{OUT}$ to the source of FET 43, which is applied to control circuit 60 at node 103.

Feedback circuit 40 may be implemented in different ways depending on the type of regulator topology used. For example, FIG. 3 shows an implementation suitable for use with a boost regulator topology.

As shown in FIG. 3, control circuit 60 includes op-amp 104 and FETs 107 and 114. The feedback signal at node 103 biases the drain of FET 107. As shown in FIG. 3, inverting terminal 106 is connected to a preset reference voltage ($V_{REF}$).

In operation, op-amp 104 acts as a voltage feedback amplifier and generates a signal at output 108 that maintains the voltage at non-inverting input 105 (and node 103) substantially equal to the value set by reference voltage $V_{REF}$. As the differential between $V_{OUT}$ and $V_{IN}$ of regulator 200 starts to increase (i.e., $V_{OUT}-V_{IN}$), so does the magnitude of the $I_{FB}$ signal provided by feedback circuit 40 and vice versa. As the feedback signal increases, op-amp 104 turns FET 107 on harder in order to sink feedback current $I_{FB}$ and maintain the voltage at node 103 substantially equal to $V_{REF}$. This decreases the equivalent resistance of FET 107. It also decreases the equivalent resistance of FET 114 because output 108 is connected to the common gate terminal of FETs 107 and 114. As a result, the amount of current that slope signal generator circuit 80 can conduct ($I_{SLOPE}$) increases, directly increasing the amount of slope compensation provided.

In the configuration shown, FETs 107 and 114 act as voltage variable resistors. That is, at different gate voltages, their equivalent resistance changes. Thus, the amount of current that FETs 107 and 114 can sink (and thus the amount of current that feedback circuit 40 and slope signal generator circuit 80 can conduct) is dependent on the voltage present at their common gate. The equivalent resistance of FETs 107 and 114, operating in the linear region, may vary according to the following relationship:

$$R_{FET} \approx \frac{1}{Kn \cdot \frac{W}{L}(Vg - Vt)} \tag{1}$$

Where Kn=mobility constant, W=device channel width, L=device channel length, Vg=gate voltage (source grounded), and Vt=threshold voltage.

As shown in the right-hand side of FIG. 3, the drain of FET 112 may be connected to a control voltage $V_C$ through $R_{SLOPE}$ resistor 226. The gate of FET 112 is connected to output 118 of op-amp 110. Non-inverting terminal 116 is coupled to a ramping waveform $V_{RAMP}$, (e.g., a sawtooth waveform), and inverting terminal 117 is connected to node 113, which is the common source/drain terminal of FETs 112 and 114. The slope compensation signal, $I_{SLOPE}$ produced by the arrangement shown in FIG. 3 may be extracted from the signal at the drain terminal of FET 112.

In operation, the ramping waveform is applied to non-inverting terminal 116, causing a similarly shaped waveform to be produced at the source of FET 112 (i.e., node 113). This waveform is preferably generated by op-amp 110 and FET 112 such that it is substantially in phase with the ramping waveform. This is done to coordinate production of the slope compensation signal with the switching of power switch 204 (FIG. 4). Such a ramp signal may be derived from an oscillator circuit in voltage regulator 200 (not shown).

Generally speaking, FET 112 conducts a slope compensation current ($I_{SLOPE}$) from control voltage $V_C$ based on the magnitude of the output signal produced by op-amp 110 and limited by the equivalent resistance of FET 114. For example, as the ramping waveform applied to op-amp 110 progresses toward its peak, the magnitude of the signal at the source of FET 112 increases correspondingly. However, as the ramping waveform progresses toward its minimum, the magnitude of signal applied to the source of FET 112 decreases. Thus, the current ($I_{SLOPE}$) conducted by FET 112 tends to increase or decrease depending on the slope of the ramping waveform. For example, if the slope of the ramping waveform is positive (i.e., its value is going from smaller to larger), the current passing through FET 112 ($I_{SLOPE}$) is increasing, whereas if the slope is negative, (i.e., its value going from larger to smaller) $I_{SLOPE}$ is decreasing.

In FIG. 3, the drain of FET 114 is connected to the source of FET 112. With this configuration, the amount of current that can be conducted by FET 112 at any given time is controlled by FET 114. For example, as can be seen from FIG. 3, at no time may FET 112 conduct more current than FET 114. This is because FET 114 is connected in between the source of FET 112 and ground. In this way, the magnitude of the slope compensation signal necessary to provide optimum slope compensation is imposed on $R_{SLOPE}$ 226.

To provide the best linearity for slope compensation circuit 100, the impedance FETs 107 and 114 should be substantially proportional to one another (e.g., substantially equal to one another). The impedance of FETs 107 and 114, used in conjunction with the boost topology of FIG. 4, may be calculated by:

$$R_{FET} = \frac{V_{REF}}{I_{FB}} = \frac{V_{REF} \cdot R_{FB}}{V_{DIFF}} \tag{2}$$

where $R_{FET}$ is the equivalent resistance of FETs 107 and 114, $V_{REF}$ is the reference voltage provided to op-amp 104, $I_{FB}$ is the feedback current provided by feedback circuit 40, and $R_{FB}$ is the resistance of resistor 42, and $V_{DIFF}=(V_{OUT}/2-V_{IN})$ for a boost topology. In a buck topology (not shown), feedback circuit 40 may be configured somewhat differently and $V_{DIFF}=(V_{OUT}-V_{IN}/2)$. In a buck-boost topology (not shown), feedback circuit 40 may be configured as described above, and $V_{DIFF}=(V_{OUT}-V_{IN})$.

The slope compensation current ($I_{SLOPE}$) may be calculated by:

$$I_{slope} = M_{RAMP} \cdot \frac{V_{DIFF}}{V_{REF} \cdot R_{FB}} \quad (3)$$

where $M_{RAMP}$ is the slope of the ramp signal and where $V_{DIFF}$ changes as mentioned above with respect to regulator topology.

$$I_{slope} = M_{RAMP} \cdot \frac{V_{DIFF}}{V_{REF} \cdot R} \quad (3)$$

An example of voltage regulator 200 suitable for use with slope compensation circuit 100 is shown in FIG. 4. As shown in FIG. 4, voltage regulator 200 includes an inductor 202, a power switch transistor 204, a sensing resistor 206 ($R_{SENSE}$), a catch diode 208, filter capacitors 210 and 224, a latch 212, a transistor driver 214, a current comparator ($I_{COMP}$) 216, resistors 218 and 220, an error amplifier 222, a resistor 226 ($R_{SLOPE}$), and slope compensation circuit 100.

The voltage regulator of FIG. 4 may operate as follows. An oscillator circuit (which may be any circuit suitable for producing substantially in-phase ramp and clock signals) supplies a control signal (CLOCK) that sets latch 212. While latch 212 is set, it provides a signal to driver 214 that causes power switch 204 to turn ON and provide current from an input voltage source $V_{IN}$ to an output node 209. Latch 212 remains set until an output signal from a current comparator 216 causes latch 212 to reset. When reset, latch 212 turns switch 204 OFF so that current is no longer drawn from $V_{IN}$. Current comparator 216 determines when to reset latch 212 by comparing a signal ($I_L$) that is indicative of the current supplied by power switch 204 with a current threshold value ($I_{TH}$) generated by an error amplifier 222 and a slope compensation signal $I_{SLOPE}$ (discussed in more detail below).

As shown in FIG. 4, error amplifier 222 senses the output voltage of regulator 200 via a feedback signal $V_{FB}$ created by the voltage divider of resistors 218 and 220. Error amplifier 222, which may be configured as a transconductance amplifier, compares $V_{FB}$ with a reference voltage ($V_{CREF}$) that is also connected to amplifier 222. A control signal, $V_C$, is generated in response to this comparison. The $V_C$ control signal is filtered by a capacitor 224 and passed through resistor 226 to produce a current signal.

As shown in FIG. 4, the value of $I_{TH}$ establishes the threshold point at which current comparator 216 trips. Therefore, as $I_{TH}$ decreases, the amount of peak current that can pass through switch 204 decreases to maintain a substantially constant output voltage. However, as mentioned above, current-mode voltage regulators can become unstable when the duty cycle exceeds 50%. To prevent this instability, a duty cycle proportional slope compensation signal may be subtracted ($I_{SLOPE}$) from the feedback signal ($I_{TH}$) to increase the rate of current rise perceived by regulator 200. This is accomplished in FIG. 4 by connecting the slope compensation circuit (e.g., the drain of FET 112) to node 227. As the ramp signal ($V_{RAMP}$) applied to slope compensation circuit progresses toward its peak, the voltage at the source of FET 112 (FIG. 3) rises, allowing current to flow, which causes $I_{TH}$ to decrease. Current comparator 216 interprets this as: 1) a decrease in the rate of current discharge by inductor 202 and 2) an increase in the rate of current charge in inductor 202. This causes the perceived rate of current fall in inductor 202 to be less than the rate of current rise, which allows regulator 200 to operate at duty cycles greater than 50%without becoming unstable.

In the embodiment of FIG. 4, the slope compensation signal generated by circuit 100 ($I_{SLOPE}$) 1S subtracted from the control signal $V_{ITH}$ at node 227 to provide slope compensation for regulator 200. It will be understood, however, that in other embodiments, the slope compensation signal ($I_{SLOPE}$) could be added to the current sense signal $V_{IL}$, rather than subtracted from $V_{ITH}$ if desired. In this case, the drain of FET 112 (FIG. 3) may be connected to a rail voltage rather than a control voltage $V_C$ (not shown).

The minimum slope compensation voltage required by regulator 200 is given by:

$$M_{VSLOPE} \geq \frac{V_{DIFF}}{L} \cdot Rsense \quad (4)$$

where $R_{SENSE}$ is the resistance value of the resistor used to sense output current (i.e., resistor 206), where L is the inductance of the storage inductor—i.e., inductor 202—in regulator 200 and where $V_{DIFF}$ changes as mentioned above with respect to regulator topology.

The amount of slope compensation K provided to voltage regulator 200 can be defined by:

$$K = M_{ISLOPE} \cdot Rslope \quad (5)$$

and therefore, $$\frac{M_{RAMP} \cdot V_{DIFF} \cdot Rslope}{V_{REF} \cdot R_{FB}} \geq \frac{(V_{DIFF}) \cdot Rsense}{L} \quad (6)$$

Where $R_{FB}$ is the resistor in feedback circuit 40 (i.e., resistor 42), $M_{RAMP}$ is the slope of the ramp signal used to generate the slope compensation signal, and where $V_{DIFF}$ changes as mentioned above with respect to regulator topology. Solving this equation gives the following relationship:

$$\frac{M_{RAMP} \cdot L \cdot Rslope}{V_{REF} \cdot R_{FB} \cdot Rsense} \geq 1 \quad (7)$$

Note that equation 7 expresses stability requirements in terms of circuit components and has canceled out any effects due to supply variations, such as input and output voltages. Moreover, assuming that $R_{SENSE}$ and $R_{SLOPE}$ resistors used are of the same resistor type, their tolerances do need to be taken in to account.

While the principles of the present invention have been illustrated using a boost, step-up switching regulator, persons skilled in the art will appreciate that the principles may be equally applied to other switching regulator topologies, including for example, buck, step-down switching regulators and buck-boost switching regulators. Thus, persons skilled in the art will appreciate that the principles of the present invention can be practiced by other than the described embodiments which are presented for purposes of Illustration and not of limitation, and the present invention is limited only by the claims which follow.

What is claimed is:

1. A method for generating a slope compensation signal for use with a switching voltage regulator that provides a regulated voltage to a load, the method comprising:

providing a feedback signal that is a function of an input voltage provided to the voltage regulator, wherein the feedback signal is independent of a reference signal;

generating a waveform based on the frequency of a ramp signal; and adjusting a magnitude of the waveform with respect to the feedback signal to produce the slope compensation signal.

2. The method of claim 1 wherein the feedback signal is further a function of an output voltage provided by the voltage regulator.

3. The method of claim 1 wherein the adjusting further comprises creating a control signal based on the feedback signal.

4. The method of claim 3 wherein the control signal is a function of the feedback signal and a reference signal.

5. A method for generating a slope compensation signal for use with a switching voltage regulator that provides a regulated voltage to a load, the method comprising:

providing a feedback signal that is a function of an input voltage provided to the voltage regulator;

generating a waveform based on the frequency of a ramp signal;

coupling the waveform to a variable impedance circuit;

varying the impedance of the variable impedance circuit to adjust the magnitude of the waveform; and producing the slope compensation signal based on the waveform.

6. The method of claim 5 characterized by the use of a transistor as the variable impedance circuit.

7. The method of claim 5 further comprising controlling the impedance of the variable impedance circuit with respect to the feedback signal.

8. A method for generating a slope compensation signal for use with a switching voltage regulator that provides a regulated voltage to a load, the method comprising:

providing a feedback signal that is a function of an output voltage provided by the voltage regulator, wherein the feedback signal is independent of a reference signal;

generating a waveform based on the frequency of a ramp signal; and adjusting a magnitude of the waveform with respect to the feedback signal to produce the slope compensation signal.

9. The method of claim 8 wherein the adjusting further comprises creating a control signal based on the feedback signal.

10. The method of claim 9 further comprising using the control signal to control the amount of current that can pass through a circuit element.

11. The method of claim 8 wherein the feedback signal is further a function of an input voltage provided to the voltage regulator.

12. A method for generating a slope compensation signal for use with a switching voltage regulator that provides a regulated voltage to a load, the method comprising:

providing a feedback signal that is a function of an output voltage provided by the voltage regulator;

generating a waveform based on the frequency of a ramp signal;

coupling the waveform to a variable impedance circuit element; and adjusting the impedance of the variable impedance circuit element with respect to the feedback signal to control the magnitude of the waveform, thereby producing the slope compensation signal.

13. The method of claim 12 characterized by the use of a transistor as the circuit element.

14. The method of claim 13 wherein the transistor is configured to function as a variable impedance element.

15. A circuit that generates a slope compensation signal for use with a switching voltage regulator, the circuit comprising:

a feedback circuit that provides a feedback signal that is a function of an output voltage provided by the voltage regulator;

a slope signal generator circuit that generates a waveform based on the frequency of a ramp signal; and a control circuit that includes at least one circuit element having a variable impedance characteristic coupled to the feedback circuit and the slope signal generator circuit, wherein the control circuit controls the impedance characteristic of the at least one circuit element with respect to the feedback signal to adjust the magnitude of the waveform to produce the slope compensation signal.

16. The circuit of claim 15 wherein the feedback signal is further a function of an input voltage provided to the voltage regulator.

17. The circuit of claim 15 wherein the feedback signal is proportional to the difference between an input voltage provided to the voltage regulator and the output voltage.

18. The circuit of claim 15 wherein the control circuit creates a control signal with respect to the feedback signal.

19. The circuit of claim 18 wherein the control signal is coupled to the at least one circuit element to control its impedance characteristic.

20. The circuit of claim 19 wherein the circuit element in the control circuit is a first transistor.

21. The circuit of claim 20 wherein the first transistor is configured to function as a variable resistor.

22. The circuit of claim 15 wherein the slope signal generator circuit further comprises an amplifier circuit and a transistor, the amplifier circuit being coupled to the transistor for imposing the ramp signal on the transistor.

23. The circuit of claim 22 wherein the magnitude of the waveform produced by the transistor varies with respect to the impedance of the at least one circuit element.

24. The circuit of claim 20 wherein the control circuit further comprises a second transistor and wherein the first transistor and the second transistor have a common gate node.

25. The circuit of claim 24 wherein the impedance of the first transistor is substantially proportional to the impedance of the second transistor.

26. The circuit of claim 24 wherein the impedance of the first transistor is substantially equal to the impedance of the second transistor.

27. The circuit of claim 24 wherein the first and second transistors are field-effect-transistors operating in the linear region.

28. The circuit of claim 24 wherein the control circuit further comprises an amplifier circuit that has a first input terminal coupled to the feedback signal, a second input terminal coupled to a reference signal, and an output configured to provide the control signal to the common gate of the first and second transistors.

29. The circuit of claim 28 wherein the impedance of the first and second transistors varies with respect to the feedback signal.

* * * * *